United States Patent [19]

Dovman

[11] 4,145,858

[45] Mar. 27, 1979

[54] WINDOW GRILLE CONSTRUCTION

[76] Inventor: Nathan Dovman, 6713 Akron St., Philadelphia, Pa. 19148

[21] Appl. No.: 848,342

[22] Filed: Nov. 3, 1977

[51] Int. Cl.[2] ..... E04B 1/48; E06B 3/70

[52] U.S. Cl. ..... 52/456; 52/311; 52/668

[58] Field of Search ..... 52/311, 456, 668, 656, 52/475

[56] References Cited

U.S. PATENT DOCUMENTS

| | | | |
|---|---|---|---|
| 3,332,188 | 7/1967 | Schaefer | 52/656 X |
| 3,356,403 | 12/1967 | Sak et al. | 52/656 X |
| 3,748,814 | 7/1973 | Cribben | 52/668 |
| 3,791,095 | 2/1974 | Martin | 52/456 X |
| 3,848,390 | 11/1974 | Anderson et al. | 52/656 X |
| 3,946,531 | 3/1976 | Armstrong | 52/668 X |
| 4,060,950 | 12/1977 | Rackard et al. | 52/668 X |

*Primary Examiner*—J. Karl Bell

*Attorney, Agent, or Firm*—Edelson and Udell

[57] ABSTRACT

A window grille set of pre-fabricated tubular members of a uniform cross-section having flat top, bottom and side walls which are provided with means for their joinder in crossed relation to form a self-sustaining grille assembly in which said members serve in the manner of window sash mullions to provide it with multiple light openings. The mullion-like members are provided with interlocked cross-lapped joints at each point where they cross one another and where said members are angularly related to provide diamond-shaped "lights" the opposite ends of each contiguous pair thereof are held together in miter-jointed relation by a spring-biased clip inserted into the hollow mitered extremities of said paired members. In its assembled form the grille is designed to be installed as a unit and hermetically sealed within the space conventionally provided between the spaced panes of thermal insulated window sashes.

5 Claims, 8 Drawing Figures

FIG. 1
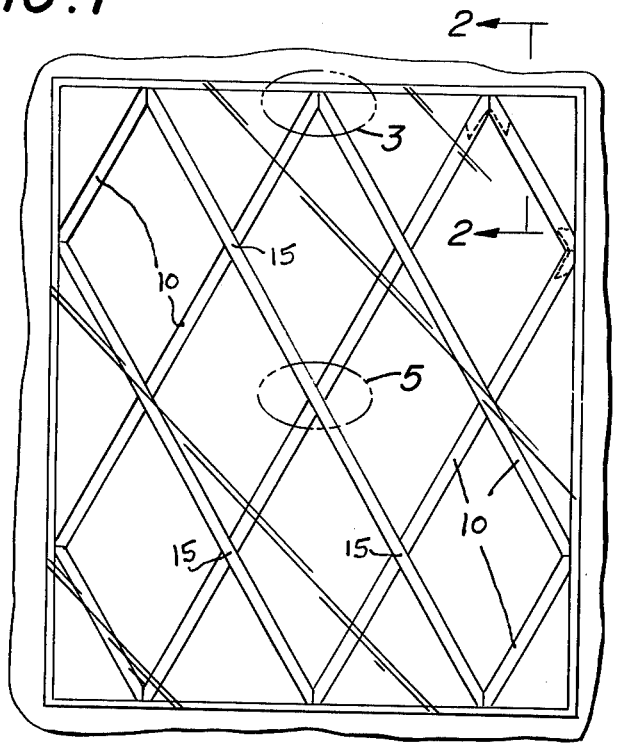
FIG. 2
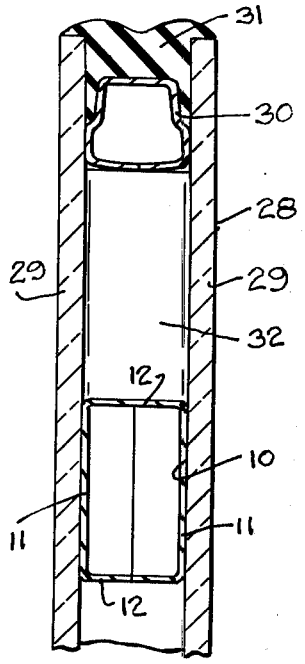
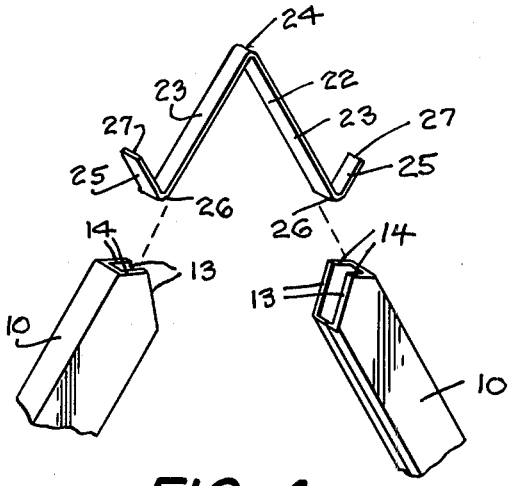
FIG. 4
FIG. 3
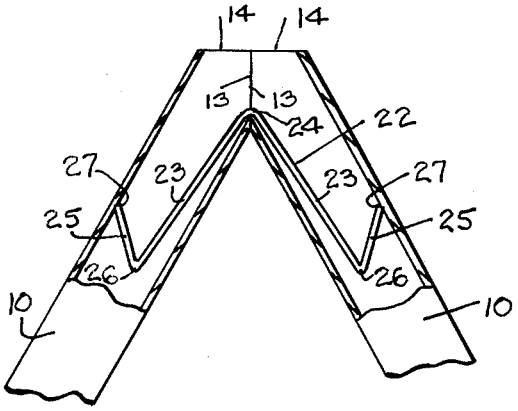

FIG. 5
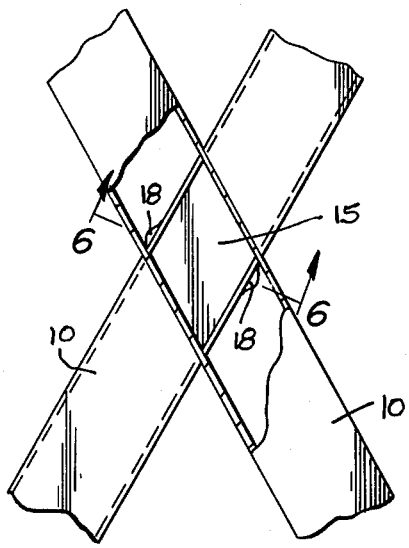
FIG. 6
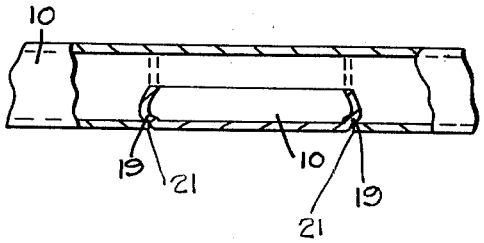
FIG. 7
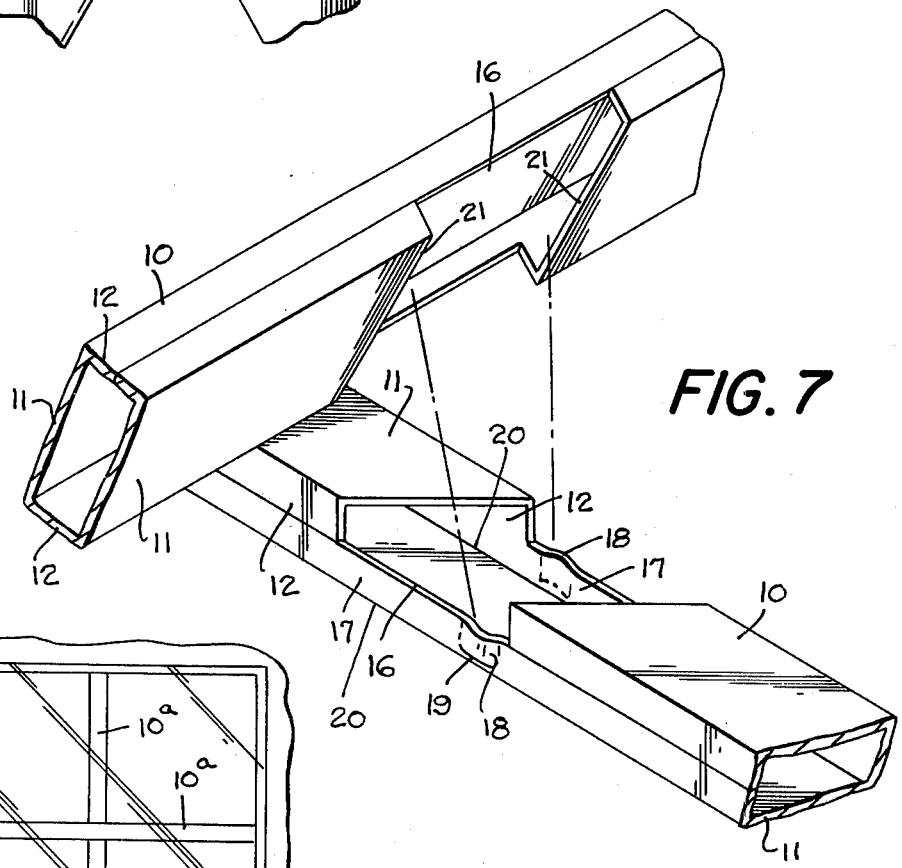
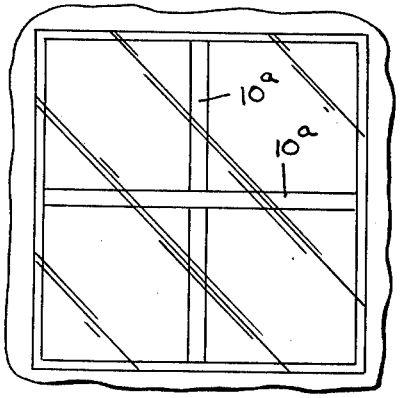
FIG. 8

WINDOW GRILLE CONSTRUCTION

This invention relates generally to the construction of window grilles and more particularly to those which are adapted for incorporation in windows having an hermetically sealed thermal insulating space confined between a pair of spaced window panes of glass or other such transparent material.

Among the principal objects of the present invention is the provision of pre-formed grille-forming members which may be compactly packaged and shipped in sets thereof for subsequent assembly into a substantially self-sustaining grille unit for installation as an assembly in a window of the above-mentioned character for which the grille is designed.

A further object is to provide an improved construction of joint for locking together the discrete grille-forming members at each of the points where such members cross one another to thereby insure that the grille in its assembled form is of a uniform thickness throughout its entire extent with its opposite surfaces respectively disposed in spaced parallel planes enabling it (the assembled grille) to be snugly sandwiched between the spaced panes of the thermal window.

Still another and important object of the present invention is to provide a means for quickly and expeditiously miter-jointing the contiguous ends of said grill members when the same are angularly related to form a grille having diamond-shaped openings or "lights".

Other objects and advantages of the invention will appear more fully hereinafter, it being understood that the present invention consists in the combination, construction, location and relative arrangement of parts, as described in detail in the following specification, as shown in the accompanying drawings and as finally pointed out in the appended claims.

In the accompanying drawings:

FIG. 1 is a front elevational view of a window grille constructed in accordance with the principles of the present invention, the grille being shown in its assembled form hermetically sealed between the double panes of a thermal barrier window to provide the same with a plurality of diamond-shaped openings or "lights";

FIG. 2 is a partial vertical sectional view of the grille-fitted window as taken along the line 2—2 of FIG. 1;

FIG. 3 is a front elevational view, shown partially in section, of a jointed pair of the grille elements inscribed within the broken line circle 3 of FIG. 1;

FIG. 4 is an exploded view showing in perspective the mitered ends of a pair of the grille elements and the clip employed for jointing the elements together;

FIG. 5 is a front elevational view, shown partially in section, of a pair of the grille elements jointed intermediate the ends thereof as inscribed within the broken line circle 5 of FIG. 1;

FIG. 6 is a sectional of the intermediate joint as taken along the line 6—6 of FIG. 5;

FIG. 7 is an exploded view showing in perspective a pair of the grille elements adapted to be jointed together in crossed relation intermediate their ends as shown in FIG. 5; and FIG. 8 is a front elevational view showing a modified arrangement of the interconnected grille members to provide the window with a plurality of square openings or "lights".

Referring now more particularly to the drawings, it will be observed that the grille of the present invention is especially designed for incorporation in windows of the double pane thermal insulation type to provide the same with decorative diamond-shaped openings or "lights" as illustrated in FIG. 1 or with square-shaped openings or "lights" as illustrated in FIG. 6.

The grille itself, which in its assembled form is adapted to be sandwiched between the glass panes of the window, is formed of a plurality of individual elongated members 10 which are each of a uniformly hollow cross-section pre-cut to length and otherwise prepared as hereinafter described for self-sustaining assembly into the form desired for incorporation in the window.

Preferably, the members 10 are each fabricated of sheet metal or other suitably rigid material into the shape of a flattened tube having relatively wide parallel side walls 11—11 and narrow side walls 12—12, which members are adapted for assembly in crossed relation as shown to provide the configuration of the openings or lights desired for a particular window.

In the case where the grille is to be formed with diamond-shaped lights, as in the window illustrated in FIG. 1, the opposite ends of each of the grille members 10 are transversely cut, as see FIGS. 3 and 4, to provide the right-angularly related edges 13 and 14 so that when the corresponding ends of adjoining pairs of said members are joined together they form a truncated miter joint wherein the cut edges 13—13 are disposed in abutting relation while the cut edges 14—14 of each said pair of members are commonly disposed in a flat plane extending normal to the line which bisects the angle formed by said pair of the joined members 10.

In addition to the aforesaid mitered end cuts of the members 10, each of the latter in the regions where they cross one another, are provided with cross-lap joints 15, each member at such cross-over joint being half-lapped, as at 16 best shown in FIG. 7, by angularly cutting the members cross-wise to remove corresponding half-portions of the contiguous walls thereof so that they may be lap-jointed together in their angularly crossed relation.

By so cross-lap jointing the members 10 at the points where they cross one another, upon assembly thereof into grille formation, all of the exposed surfaces of the grille at their cross-over points are completely flush with the remain surfaces thereof and thus the grille throughout its full extent is of a uniform thickness equal to that of each of the grille members 10 itself.

In order to hold the grille members in a self-sustaining form for easy installation as a unit within the double-pane window sash for which it is designed, the opposite longitudinally extending side wall portions 17 of the half-lap 16 are respectively provided with outwardly pressed protrusions or detents 18 to each form a shoulder 19 spaced from the contiguous uncut edge 20 of said member a distance equal to or just slightly greater than the thickness of the material of which the member 10 is formed, as see FIGS. 5, 6 and 7.

It will be observed that upon interfitting together the cross-lapped portions of the members 10 into their relatively flush condition shown in FIG. 6, the transversely extending edges 21—21 of the member 10 which is being joined to the member 10 having the detents 18—18 will snap past the shouldered edges 19—19 of the detents 18 to underlie the latter and so hold together the cross-lapped members 10 of the grille. Preferably, these detents 18—18 at each of the cross-lapped joints are relatively offset lengthwise of the member 10 is which they are formed, as see FIG. 7, so that they respectively engage the edges 21—21 of interfitted member 10 at diagonally opposed points thereof.

It will be observed that whereas in the case of a grille designed to have diamond-shaped openings or lights, as shown in FIG. 1, the half-laps 16 of the jointed grille members extend angularly across the lengths thereof, in grilles designed to have square or rectangular shaped openings, as shown in FIG. 8, the cross-laps would extend at right angles across the lengths of the grille members 10[a].

The mitered ends of each jointed pair of the angularly related grille members 10 are held together against separation by means of W-shaped clips 22 formed of spring metal, each of a width adapting it to be snugly fitted in the open hollow end portions of the paired grille members. Each clip includes a central pair of angularly related legs 23—23 integrally joined at an apex 24 about which they may be initially compressed together and then sprung apart by the inherent spring action of the clip. The legs 23—23 are respectively provided with reversely bend relatively short legs 25—25 which are also normally biased outwardly of the central legs about apices 26—26 of the angles formed between the long and short legs of the clip.

It will be apparent that when the reversely bent ends of a clip are forcibly inserted into the hollow mitered ends of a contiguous pair of the grille members, the free edges 27—27 of the short legs 25—25 of the clip under the outward biasing effort thereof will resiliently engage the inner surfaces of the outermost side walls of the jointed grille members and become so firmly bound against the engaged surfaces as to prevent any retraction of the clip from its fully inserted position as shown in FIG. 3. At the same time the angle between the legs 23—23 of the clip, particularly in the immediate region of its apex 24 will have been compressed sufficiently to enable the clip 22 to hold the jointed grille members in their abutting angular relation as shown in FIGS. 1 and 3.

It will be noted that in the case of the grille having the diamond-shaped lights as shown in FIG. 1 the truncated extremities along each of the perimetral sides of the assembled grille are disposed in a common flat plane which closely adjoins and is parallel to the inner surface of the corresponding side of the window in which the grille is fitted.

The window in which the grille is fitted, generally designated 28 in FIG. 2, is of the conventional thermal insulation type having a laterally spaced pair of glass panes 29—29 which embrace therebetween a metal spacing frame 30 to which the glass is bonded by a suitable compound 31 to provide an hermetically sealed thermal insulating space 32 between the spaced panels of glass. The grille of the present invention assembled into its rigidified self-sustaining shape as hereinbefore described is readily fitted into the internal frame 30 of the window for disposition between the glass panes thereof prior to the final step of hermetically sealing the latter in place, thus obviating the need of securing any one or more of the grille members 10 to the frame member 30.

The flat cut end extremities of the assembled grille members 10, as provided by the truncated miter joints of the grille construction shown in FIG. 1 and by the flat cut ends of the right-angle cross-lapped grille members shown in the construction of FIG. 8, insure their flatwise abutment against the inner surfaces of said frame and so provide a snug, distortionless and neat appearing fit of the grille within the internal frame 30 of the window.

It will be understood, of course, that the present invention is susceptible of various changes and modifications which may be made from time to time without departing from the general principles or real spirit thereof, and it is accordingly intended to claim the invention broadly as well as specifically as indicated in the appended claims.

What is claimed as new and useful is:

1. A window grille set comprising a plurality of individual elongated members cut to predetermined lengths adapted for jointed assembly in crossed relation to form a multiple light grille unit for installation within a window sash or frame, said members being all fabricated of a rigid material of relatively thin gauge shaped into the form of a flattened rectangular tube of a uniform depth and width, each of said members in the region where it is cross-wise jointed to another of said members being transversely notched for half of its depth to provide a cross-lap joint section having a pair of laterally spaced substantially parallel rigid side walls whereby the crossed members may be flush-wise interfitted by cross-lap joints, and a locking detent projecting outwardly from at least one side wall of the notched portion of one of the interfitted members for interlocking engagement with a transversely extending underlying edge of the notch of the other one of said interfitted members, said detent being pressed outwardly from a limited part of said wall in which it is formed to provide it with a shouldered seat spaced above the uncut bottom edge of said one side wall a distance substantially equal to the thickness of the material of which each of said members are formed whereby upon said cross-lap jointing of the interfitted members the said transversely extending edge of said other one of said members may be snapped past and held secure in positively fixed position by said shouldered seat of said detent.

2. A window grille set as defined in claim 1 wherein the opposite longitudinally extending side walls of the notched portion of said first one of said interfitted members are respectively provided with one of said locking detents for respectively engaging the opposite transversely extending edges of the notch of the second one of said members.

3. A window grille set as defined in claim 1 wherein said members are right-angularly cross-lap jointed to serve as mullion-like elements to provide a multiple-light grille assembly in which the lights are right-angularly cornered.

4. A window grille as defined in claim 1 wherein said members are angularly cross-lap jointed to serve as mullion-like elements to provide a multiple-light grille assembly in which the lights are diamond-shaped.

5. A window grille as defined in claim 4 wherein contiguous extremities of said angularly related members are miter-jointed in abutting relation, wherein each of said mitered joints is truncated to provide the same with openings providing access into the hollow interiors of the miter-jointed members and wherein means are inserted through said openings into said hollow interiors of said members for resiliently holding the same together in their miter-jointed relation, said last-mentioned means comprising a clip formed of flat spring metal having downwardly divergent legs normally biased away from one another and respectively provided at their bottom ends with outwardly divergent elements reversely bent at acute angles to their associated legs, said legs being respectively inserted with the apices of their said acute angles extending foremost into the hollow interiors of said miter-jointed members for effecting securement therein against unintentional removal therefrom by the binding action of the free flat edges of said reversely bent outwardly divergent elements against the outer walls of said angularly related members.

* * * * *